US006655453B2

(12) United States Patent
Head

(10) Patent No.: US 6,655,453 B2
(45) Date of Patent: Dec. 2, 2003

(54) TELEMETERING SYSTEM

(75) Inventor: Philip Head, Ascot (GB)

(73) Assignees: XL Technology LTD, Ascot (GB); TSL Technology, Southhampton (GB)

( * ) Notice: Subject to any disclaimer, the term of this patent is extended or adjusted under 35 U.S.C. 154(b) by 0 days.

(21) Appl. No.: 09/995,843

(22) Filed: Nov. 28, 2001

(65) Prior Publication Data

US 2002/0104661 A1 Aug. 8, 2002

(30) Foreign Application Priority Data

| | | |
|---|---|---|
| Nov. 30, 2000 | (GB) | 0029284 |
| Nov. 30, 2000 | (GB) | 0029462 |
| Aug. 20, 2001 | (GB) | 0120195 |

(51) Int. Cl.[7] ..... E21B 19/00; E21B 19/22
(52) U.S. Cl. ..... 166/77.1; 166/242.6; 166/385
(58) Field of Search ..... 166/380, 250.01, 166/254.2, 381, 385, 65.1, 66, 77.1, 242.2, 242.6; 175/40

(56) References Cited

U.S. PATENT DOCUMENTS

| | | | | |
|---|---|---|---|---|
| 1,107,934 A | * | 8/1914 | Hagan | 188/65.1 |
| 3,282,356 A | * | 11/1966 | Paulson et al. | 175/103 |
| 3,729,068 A | * | 4/1973 | Fuller | 188/65.1 |
| 3,807,502 A | * | 4/1974 | Heilhecker et al. | 166/385 |
| 3,825,078 A | * | 7/1974 | Heilhecker et al. | 175/57 |
| 3,825,079 A | | 7/1974 | Heilhecker | |
| 3,913,688 A | * | 10/1975 | Heilhecker et al. | 340/855.1 |
| 3,918,537 A | * | 11/1975 | Heilhecker | 175/320 |
| 3,957,118 A | * | 5/1976 | Barry et al. | 166/385 |
| 4,098,342 A | * | 7/1978 | Robinson et al. | 166/385 |
| 4,271,908 A | * | 6/1981 | Robinson et al. | 166/385 |
| 4,498,563 A | * | 2/1985 | Trahan | 188/65.1 |
| 4,534,424 A | * | 8/1985 | Ramsey | 175/40 |
| 5,294,923 A | * | 3/1994 | Juergens et al. | 340/854.9 |
| 5,435,395 A | * | 7/1995 | Connell | 166/384 |
| 5,560,437 A | * | 10/1996 | Dickel et al. | 175/40 |
| 5,722,488 A | * | 3/1998 | Normann et al. | 166/65.1 |
| 6,041,872 A | * | 3/2000 | Holcomb | 175/40 |
| 6,202,764 B1 | * | 3/2001 | Ables et al. | 175/162 |

FOREIGN PATENT DOCUMENTS

| | | |
|---|---|---|
| GB | 14 18 209 | 4/1973 |
| GB | 1 514 206 | 7/1975 |
| GB | 1 597 209 | 4/1978 |

* cited by examiner

*Primary Examiner*—William Neuder
*Assistant Examiner*—Jennifer H Gay
(74) *Attorney, Agent, or Firm*—Herbert Dubno

(57) ABSTRACT

A drillpipe line installation system, the drillpipe string being composed of drillpipe sections which are added and removed to increase and decrease the length of the drillpipe, and a length of cable is disposed within the drillpipe string. The length of this cable is greater than that of the drilipipe string when the cable is put in the drill pipe. The system includes a lower cable storage means which stows the cable in a compact manner and pays the cable out when the length of the drillpipe is increases, and an upper cable storage means which can take up the cable in a compact manner when the length of the drillpipe is decreased.

9 Claims, 10 Drawing Sheets

TELEMETERING SYSTEM

FIELD OF THE INVENTION

The present invention relates to a telemetering system, in particular, one disposed in a drillpipe.

BACKGROUND OF THE INVENTION

The conventional manner of drilling a borehole comprises lowering a drill bit into the earth, the drill bit being powered, for instance, by the rotation of the drillpipe, or by fluids circulating through the drillpipe and thence back up to the surface through the space between the drillpipe and the borehole. The drillpipe is made up of sections, new sections being added periodically at the top of the drill string to allow the drill bit to be lowered further.

Much useful data can be garnered from sensors included in the drillpipe, such as temperature and pressure. To retrieve this information at the surface requires some form of media to transmit it through. Known systems include using pressure waves through the circulating mud, and electromagnetic pulses. Better rates of transfer and less attenuation may be achieved however by using an electrical conducting element.

The simplest way of installing a conducting cable, or indeed any line, along the drill string is to wait until drilling has ceased and lower a single length down the drill string. Where it necessary to take readings from instrumentation means before the drillpipe is completed however, the cable must be lowered into the drill string, only to be withdrawn each time a new drillpipe section is added to the drill string.

One known method comprises a drillpipe incorporating conducting elements. The conducting elements of adjoining sections of drillpipe are electrically connected by sliding contacts, Such a system is expensive, and liable to develop faults as a result of fluid contaminating the connection. Many telemetry systems rely upon a segmented cable running through the drillpipe, cable sections being added in order to allow fresh sections of drillpipe to be added.

Every connection between individual lengths of cable provides a further opportunity for faults to occur.

OBJECT OF THE INVENTION

The object of the present invention is to provide an apparatus and method for disposing reliable telemetric equipment in drillpipes and the like in an efficient manner.

SUMMARY OF THE INVENTION

According to the present invention there is provide a drillpipe line installation system, the drill string being composed of drillpipe sections which are added and removed to increase and decrease the length of the drillpipe, wherein a length of cable is disposed within the drill string, the length of this cable being greater than that of the drill string at the time the cable is disposed, there being a lower cable storage means for stowing the cable in a compact manner and paying out the cable when the length of the drillpipe is increase, and an upper cable storage means which can take up the cable in a compact manner when the length of the drillpipe is decreased.

Preferably the lower cable store means is a bobbin upon which the cable is wound. Preferably the upper cable store means is a bobbin upon which the cable is wound. The cable may include a wireless transmitter capable of transmitting signals to a signal receiver. The cable may be releasably connected to a connector at its top, the cable being disconnected from the connector when a drillpipe section is to be added or removed, threaded through the drillpipe section before being reconnected to the connector, the cable including a wireless transmitter, such that signals carried by the cable can be transmitted by the wireless transmitter to be received by a signal receiving means.

According to another aspect of the present invention, there is provided a method of installing a line along a drill string or the like, the drill string being composed of drillpipe sections which are added as the drillpipe progresses, a length of cable being disposed within the drill string before the string has reached its final length, the length of this cable being greater than that of the drill string at the time the cable is disposed, the cable being releasably connected to a connector at its top, the cable being disconnected from the connector when a drillpipe section is to be added or removed, threaded through the drillpipe section before being reconnected to the connector, the cable including a wireless transmitter, such that signals carried by the cable can be transmitted by the wireless transmitter to be received by a signal receiving means.

According to a further aspect of the present invention, there is provided a method of installing a line along a drill string or the like, the drill string being composed of drillpipe sections which are added as the drillpipe progresses, a length of cable being disposed within the drill string before the string has reached its final length, the length of this cable being greater than that of the drill string at the time the cable is disposed, the cable being releasably connected to a connector at its top, the cable being disconnected from the connector when a drillpipe section is to be added or removed, threaded through the drillpipe section before being reconnected to the connector, the top of the cable being secured relative to the drillpipe after being disconnected, and reconnected by lowering the connector through the drillpipe to the top of the cable.

According to a further aspect of the present invention, there is provided a method of installing a line along a drill string or the like, the drill string being composed of drillpipe sections which are added as the drillpipe progresses, a length of cable being disposed within the drill string before the string has reached its final length, the length of this cable being greater than that of the drill string at the time the cable is disposed, the cable being releasably connected to a connector at its top, the cable being disconnected from the connector when a drillpipe section is to be added or removed, threaded through the drillpipe section before being reconnected to the connector, the cable is supported by an anchor that can be displaced upwards through the drillpipe, but which resists downward displacement through the drillpipe.

According to a further aspect of the present invention, there is provided a method of installing a line along a drill string or the like, the drill string being composed of drillpipe sections which are added as the drillpipe progresses, a length of cable being disposed within the drill string before the string has reached its final length, the length of this cable being greater than that of the drill string at the time the cable is disposed, the cable being releasably connected to a connector at its top, the cable being disconnected from the connector when a drillpipe section is to be added or removed, threaded through the drillpipe section before being reconnected to the connector, the top of the cable being secured by a tractor inside the drillpipe, the tractor capable of ascending and descending through the drillpipe when the cable is disconnected from the connector.

According to a further aspect of the present invention, there is provided a drillpipe line installation system, the drill string being composed of drillpipe sections which are added and removed to increase and decrease the length of the drillpipe, wherein a length of cable is disposed within the drill string, the length of this cable being greater than that of the drill string at the time the cable is disposed, the excess cable being stored wound upon a mandrel, the cable wound upon the mandrel being twisted as it is applied such that when the cable is twisted as the mandrel is unwound, the twisting already applied to the cable untwists.

According to a further aspect of the present invention, there is provided a drillpipe line installation system, the drill string being composed of drillpipe sections which are added and removed to increase and decrease the length of the drillpipe, wherein a length of cable is disposed within the drill string, the length of this cable being greater than that of the drill string at the time the cable is disposed, the excess cable being stored wound upon a mandrel, the cable being wound along substantially the length of the mandrel to a single cable thickness, before winding the cable along the mandrel applying a second cable thickness, and applying silicone elastomer to somewhat secure the first layer of cable to the second layer of cable.

According to a further aspect of the present invention, there is provided a drillpipe line installation system, the drill string being composed of drillpipe sections which are added and removed to increase and decrease the length of the drillpipe, wherein a length of cable is disposed within the drill string, the length of this cable being greater than that of the drill string at the time the cable is disposed, the excess cable being stored wound upon a mandrel, the cable being wound upon itself in an overlapping manner at a particular displacement along the mandrel before the cable is wound at another region of the mandrel.

Preferably the cable is wound upon the mandrel such that exposed turns of the cable have a conical shape. Preferably silicone elastomer is used to secure the turns of the cables.

According to a further aspect of the present invention, there is provided a method of installing a line along a drill string or the like, the drill string being composed of drillpipe sections which are added as the drillpipe progresses, a length of cable being disposed within the drill string before the string has reached its final length, the length of this cable being greater than that of the drill string at the time the cable is disposed, the cable being releasably connected to a connector at its top, the cable being disconnected from the connector when a drillpipe section is to be added or removed, threaded through the drillpipe section before being reconnected to the connector, the cable transmitting signals to the connector by an inductive link.

BRIEF DESCRIPTION OF THE DRAWING

A telemetering system will now be described, by way of example only and not intended to be limiting, with reference to the drawings, of which.

DESCRIPTION OF THE PREFERRED EMBODIMENT

Figure 1:
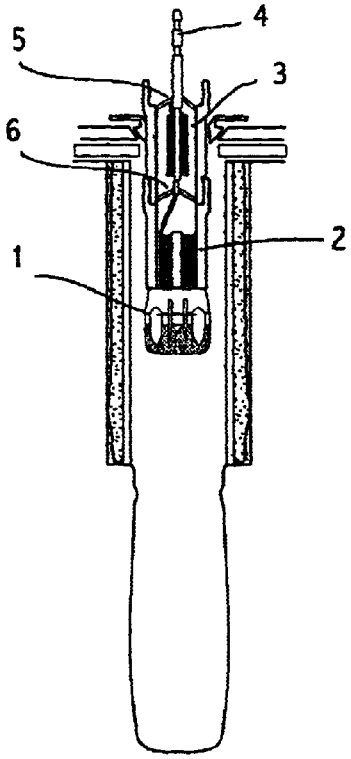
FIG. 1 shows a longitudinal section of a drill string installed in the well at surface.

FIG. 1 shows the drilling assembly 1 lowered into a well with a cable bobbin 2 and cable bobbin 3 and upper cable module 4 installed in the internal bore, with anchors 5 and 6 supporting the various bobbins or modules.

Figure 2:
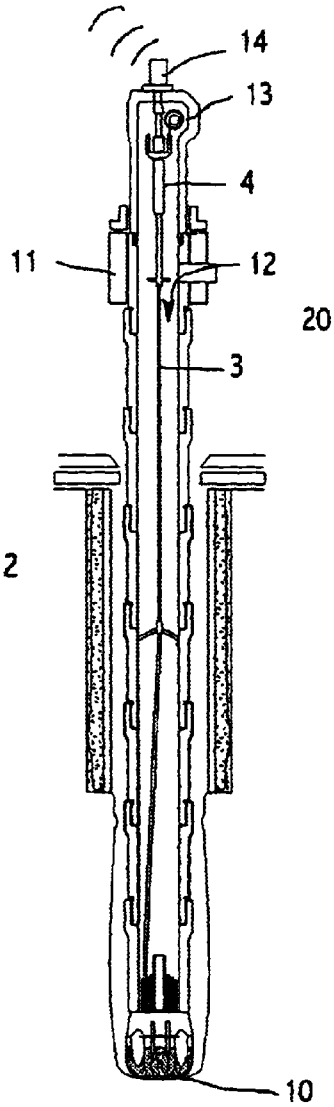
FIG. 2 shows the same view as FIG. 1 with the drilling assembly at the bottom of the borehole with the instrument wire inside the drillpipe.

The drill assembly is advanced down the well by a top drive in the conventional way. As shown in FIG. 2, the upper cable module is attached to a connection means in a winch assembly above the top drive. When the drill string's progression down the bore hole makes it necessary to add another pipe section to the drill string, the upper cable module 4 is disconnected from the connection means and allowed to rest upon an anchor 5 which holds it in position against the drillpipe. The new pipe section is added to the existing drillpipe, and the top drive and winch assembly connected to the drillpipe. The details of the connection means and winch assembly are discussed in greater detail below. When the top drive is secured to the new pipe section, the connection means are lowered through the new pipe assembly until they engage with the upper cable module 4. The upper cable module is then winched up the drill string to the winch assembly and drilling is recommenced.

As the upper cable module is winched up, cable is paid out from the upper bobbin. After the drill string has increased by a certain length by the addition of pipe sections, all the cable from the upper bobbin has been paid out. When the upper cable module is now winched up the drill string, the line pulls against the anchor 6 and the anchor is pulled up the drill string. The anchor may for example employ shear pins which give when the cable above the anchor is subjected to a sufficient force. The anchor may now be pulled upwards, but resists downward movement by use of a ratchet means.

As further pipe sections are added to the drill string, and the anchor is pulled up the drill string, the cable of the lower bobbin is paid out to accommodate the change in drillstring length.

Several bobbins may be installed in the drill string, each bobbin having a support anchor associated with it. Most conveniently, the topmost anchor would has relatively weak shear pins, so that the topmost disposable bobbin pays out first after the upper bobbin has been completely unwound. The shear pins of the second anchor are stronger than those of the topmost, so that the bobbin associated with that anchor pays out after the topmost disposable bobbin is exhausted, and so on.

Referring to FIG. 2, the drilling assemble is now at the bottom of the bore hole and drilling new formation 10. The upper reusable cable bobbin 3 is fully extended, the drillpipe is being supported and lowered by the top drive 11 and fluid is being circulated 12, a winch system 13 has pulled the upper cable module to above the top drive and the telemetry interface is being transmitted via a contactless assembly 14, which in turn transmits data wirelessly to the data collection point.

Figure 3:
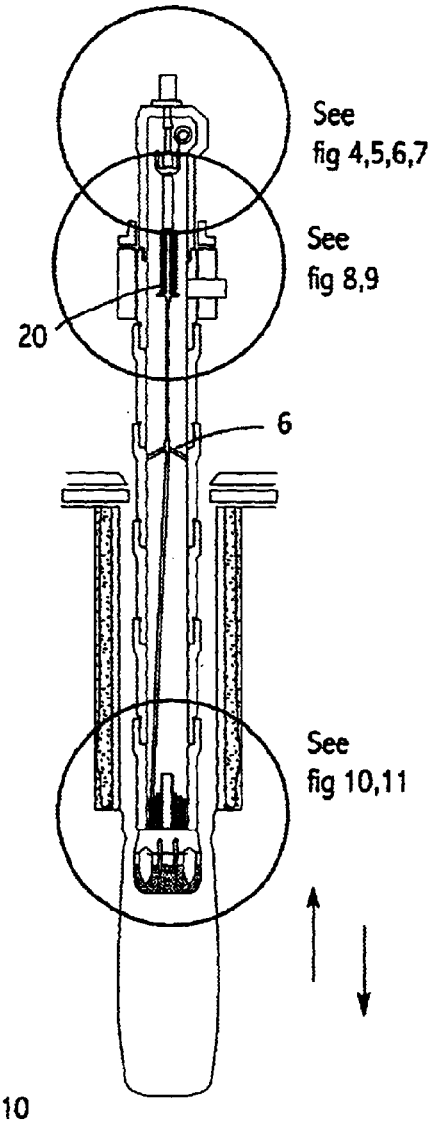
FIG. 3 shows the same view as FIG. 2 with the drilling assembly at the part way up the borehole performing a wiper trip with the excess instrument wire inside the drillpipe wind up on a rewinding bobbin at surface.

Referring to FIG. 3, at various stages of drilling an open hole it is necessary to perform a wiper trip, this requires the excess cable in the drillpipe to be rewind. This is achieved using a rewinding mechanism 20, which rotated the upper bobbin to wind the rewindable cable 3 back onto the upper bobbin. The remaining straight cable in the drillpipe which is supported by the anchor 6 is unaffected as the bobbin is rewound.

Figure 4:
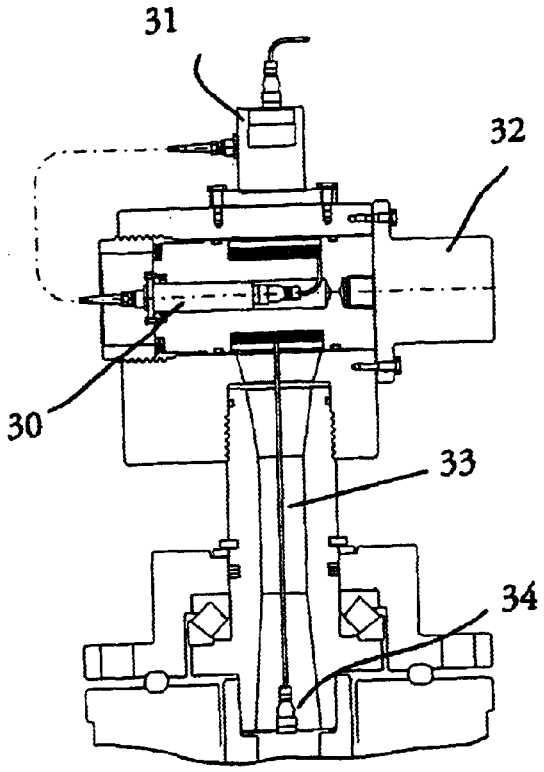
FIG. 4 shows one version of the surface threader with optical sliprings and "hardwiring" to external communication system.

Referring to FIGS. 4, 5, 6 and 7 there are shown various embodiments of the cable threading system. FIG. 4 shows a cable winding system with optical slip rings 30, 31 and electrical driven drum 32 lowering and raising a cable 33 which is terminated with a connector 34. This connector mates up with the upper cable module and provides a positive connection to the downhole assembly. It has to be disconnected and reconnected each time a new section of drillpipe is added. It is so designed to allow the cable 33 to remain stationary inside the drillpipe while the drillpipe is rotated by the topdrive.

When adding a new pipe section, the upper cable module and the connector may be disconnected manually, the new pipe section positioned and the connector lowered sufficiently by the winch means, before being manually reconnected.

Figure 5:
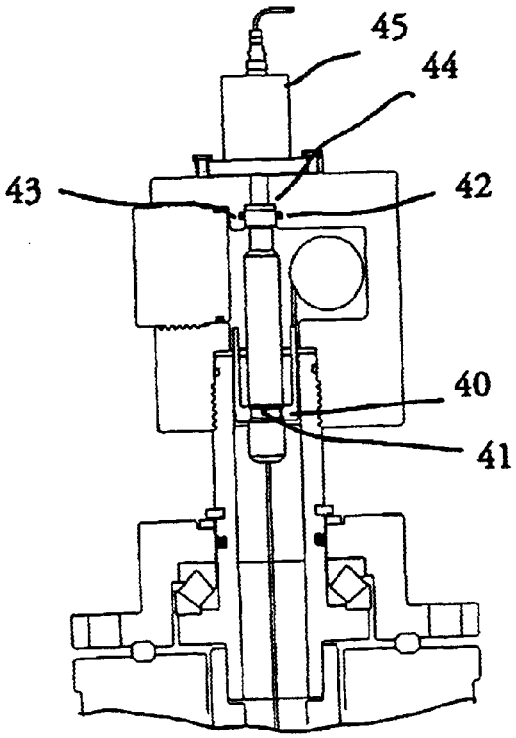
FIG. 5 shows a second version of the surface threader with a optical non contacting interface.

FIG. 5 shows a second embodiment of a winching system in which a which lowers a fishing collet 40, this locates on a profile 41 of the upper cable module and allows it to pull the upper cable module to receptacle 42 above the top drive. The receptacle has a seal 43 and flushing mechanism not show, which allows a contactless telemetry connection 44 to be made, which then sends the passes the signal via an optical slip ring 45 to the surface computer. The use of the fishing collet allows the disconnection and reconnection of the upper cable module to the connection means when fitting a new pipe section to be carried out inside the drill string, without manual intervention.

Figure 6:
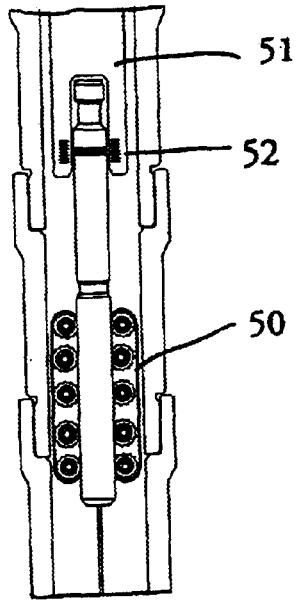
FIG. 6 shows a upper cable module with a tractor which winches itself up to an inductive coupling.
Figure 7:
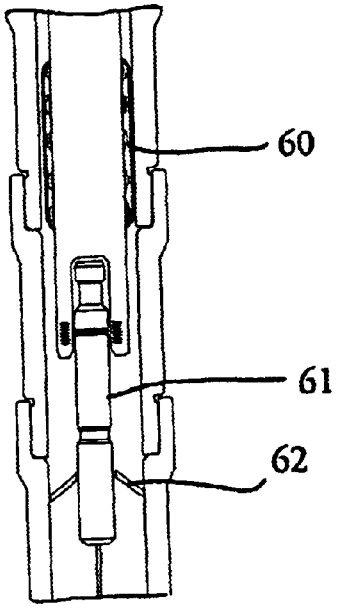
FIG. 7 shows a tractor device which comes down from the top drive and collects the upper cable module, incorporating an anchor device which supports the upper cable module when the tractor disengages.

FIG. 6 shows a further embodiment with a smart self propelled upper cable module 50, as each new drillpipe is added it walks itself up the drillpipe and docks in a receptacle 51. This contains a induction coupling 52 for data transfer, and power transfer to recharge the battery pack of the unit 50. Referring to FIG. 7, this shows a further embodiment with a traction tool 60 being driven down the drillpipe to collect the upper cable module 61 This then winches the upper cable module to the next drillpipe connection and sets its anchors 62 so that it is supported ready for the next drillpipe to be added. The systems in FIGS. 6 and 7 remove all external involvement and are more attractive for that reason.

Figure 8:
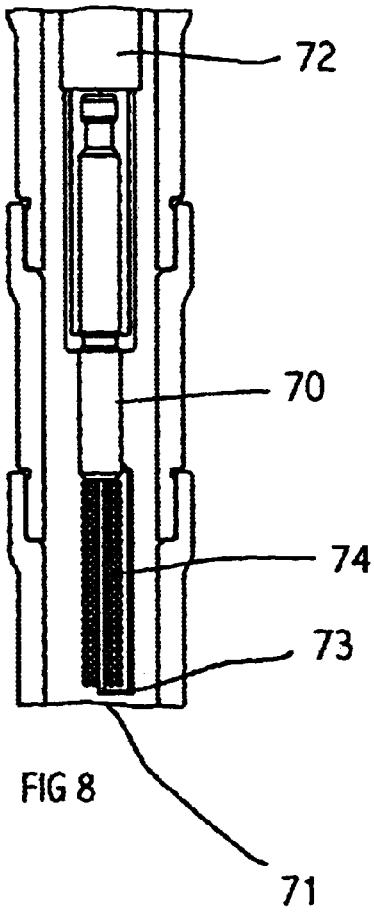
FIG. 8 shows a device for rewinding the cable when it is necessary to perform a wiper trip.
Figure 9:
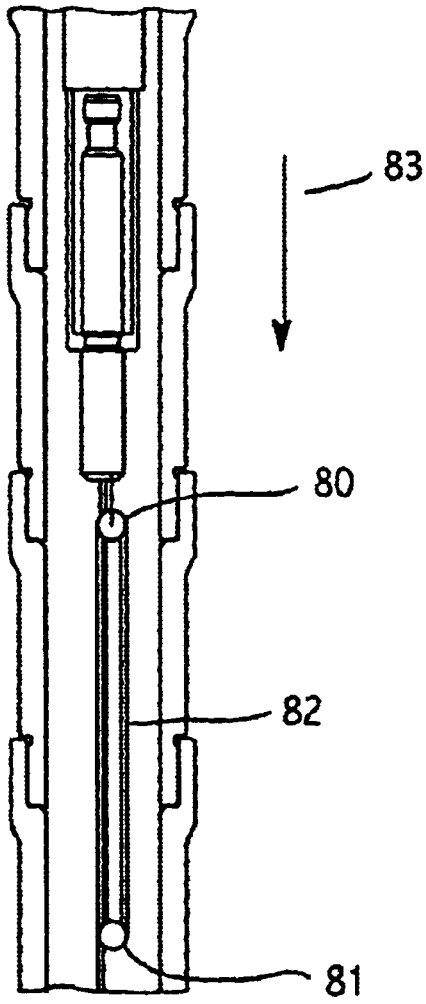
FIG. 9 shows another embodiment of a device for accommodating the additional cable during a wiper trip.

Referring to FIGS. 8 and 9, during the drilling process it is sometimes necessary to remove some sections of drillpipe to perform a wiper trip, this ensures the drilled hole remains full bore and has not sloughed. The drillpipe does not return to surface but to the last casing shoe only, and them goes back to the bottom and recommences drilling. Consequently, FIG. 8 shows an embodiment to rewind the cable on an attachment 71 to the upper cable module 70, winding is achieved by an electric motor 72 the straight cable below the module 70 is draw up via a threading mechanism 73 and wound onto a mandrel 74. FIG. 9 shows an alternative embodiment in which pulleys 80 and 81 are installed and as the upper cable module is lowered 83, the additional cable slack is accommodated between the pulleys 82

Figure 10:
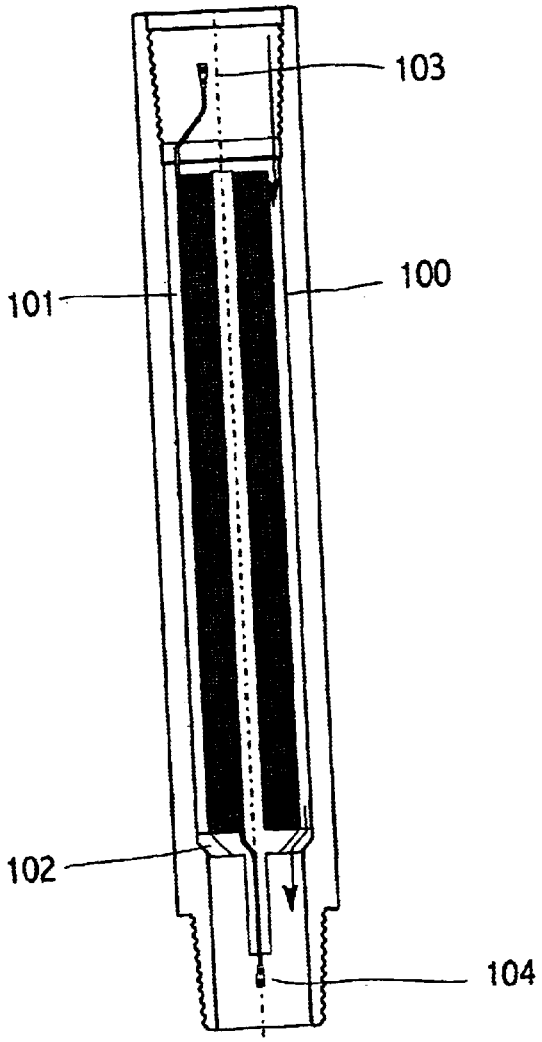
FIG. 10 shows a downhole cable bobbin with annular flow around the outside of it.
Figure 11:
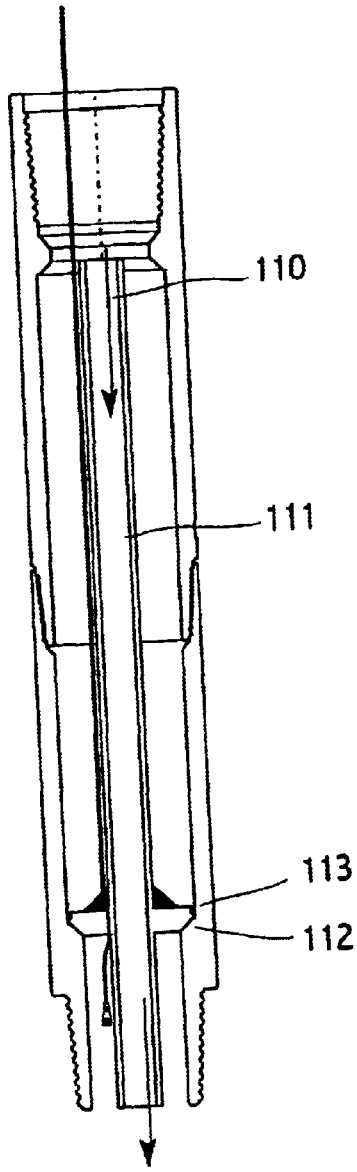
FIG. 11 shows a downhole bobbin with flow down its central mandrel.

Referring to FIGS. 10 and 11, is shown two embodiments of the downhole cable bobbin. FIG. 10 shows one embodiment with the flow of fluid 100 being forced around the outside of the cable in the annular gap 101, passing through slots 102 at the bottom of the bobbin. The cable is terminated at both ends but a quick connect 103 and 104. FIG. 11 shows a second embodiment with flow 110 being forced down the hollow bobbin mandrel 111. The bobbin itself rests on a shoulder 112 and includes a seal 113.

Figure 12:
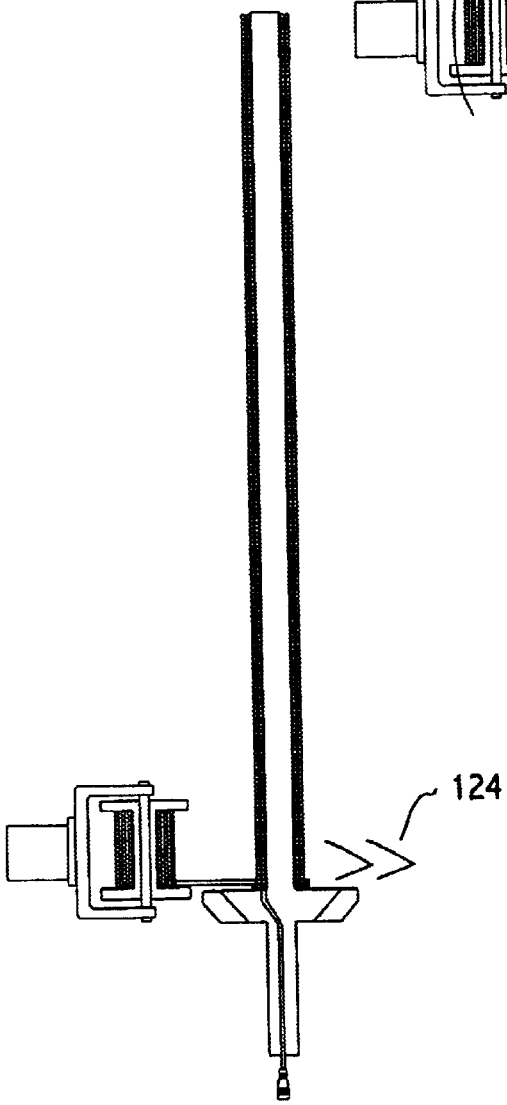
FIGS. 12, 13, and 14 show a cable winding process.
Figure 13:
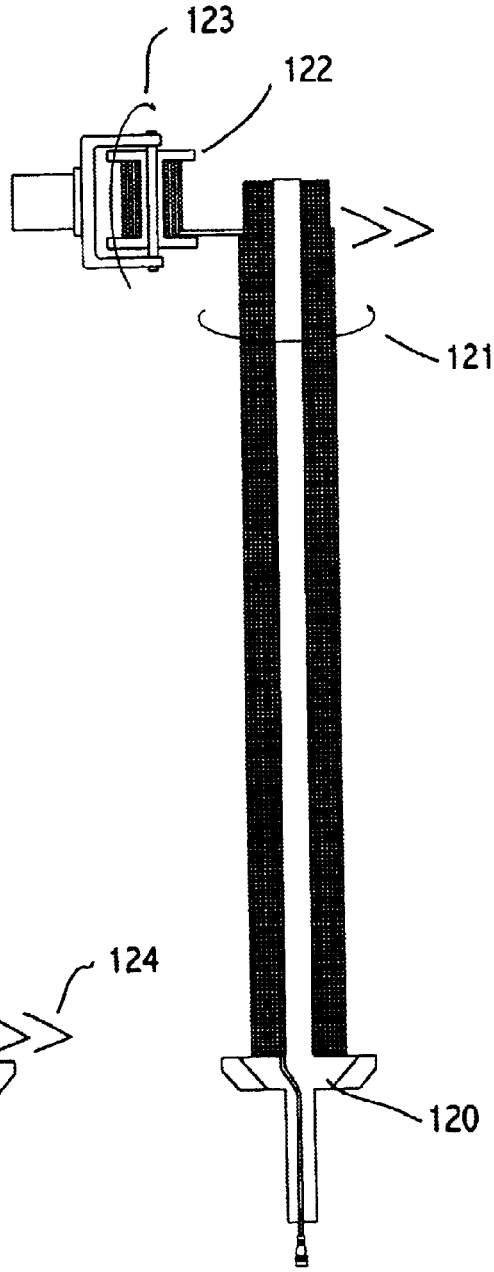
Figure 14:
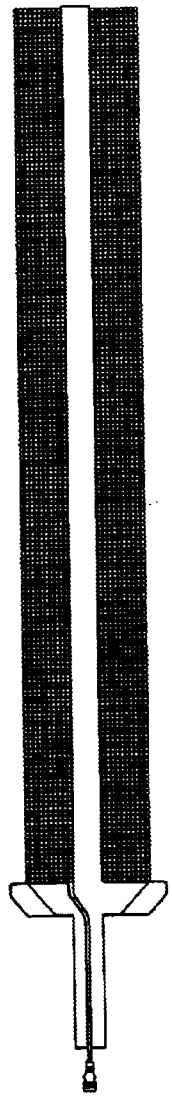

Referring to FIGS. 12, 13 and 14 there is shown one bobbin winding technique. The cable is wound onto the mandrel in single layers from one end of the mandrel to the other. As the mandrel 120 makes one full turn (i.e. through 360°) 121, cable is wound off from a storage bobbin 122, but which in turn is rotated one full turn 123 so as to pre twist the cable so that when it pulled out during deployment it does not induce any twisting or stress in the cable. As the cable is laid onto the mandrel a thin film of silicone elastomer is sprayed 124 onto the cable which when it sets has enough strength to retain the fiber in place but allows the fibre also to pulled freely out as required.

Figure 15:
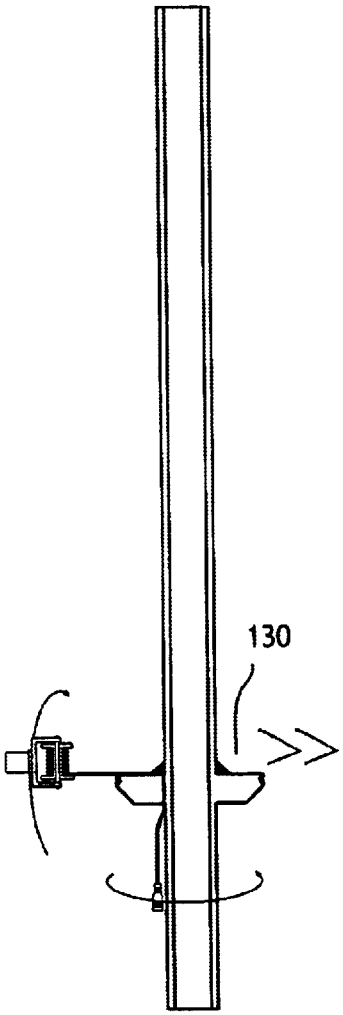
FIGS. 15, 16 and 17 show a second cable winding process.
Figure 16:
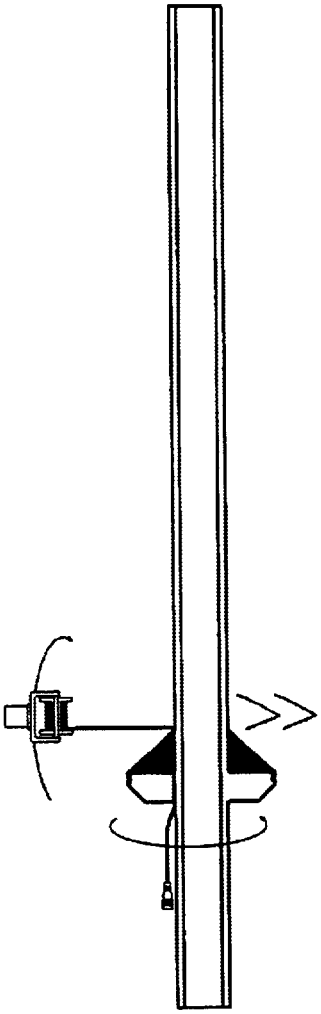
Figure 17:
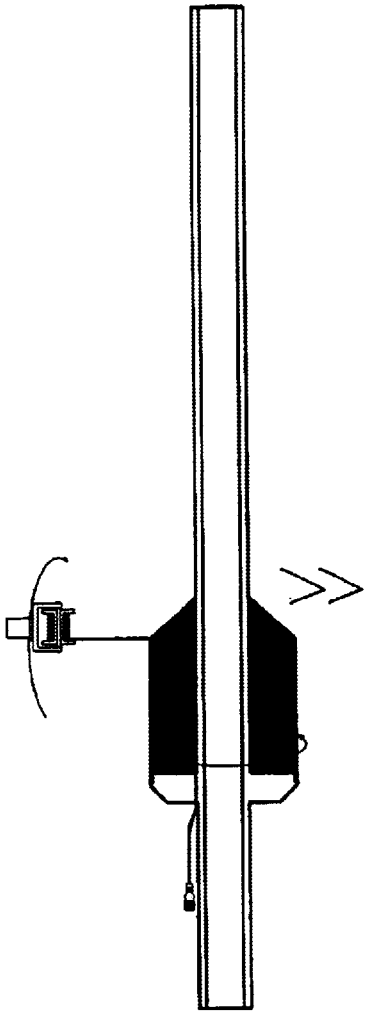

Referring to FIGS. 15, 16, and 17 there is shown a further embodiment of a cable winding system in which a the fiber is wound in a ramp form 130. This may be more advantageous if the mandrel is very long and the annular gaps are quite small, and is particular advantageous when winding the cable onto a hollow mandrel. Again, the storage bobbin make one full turn for each full turn of the mandrel.

Figure 18:
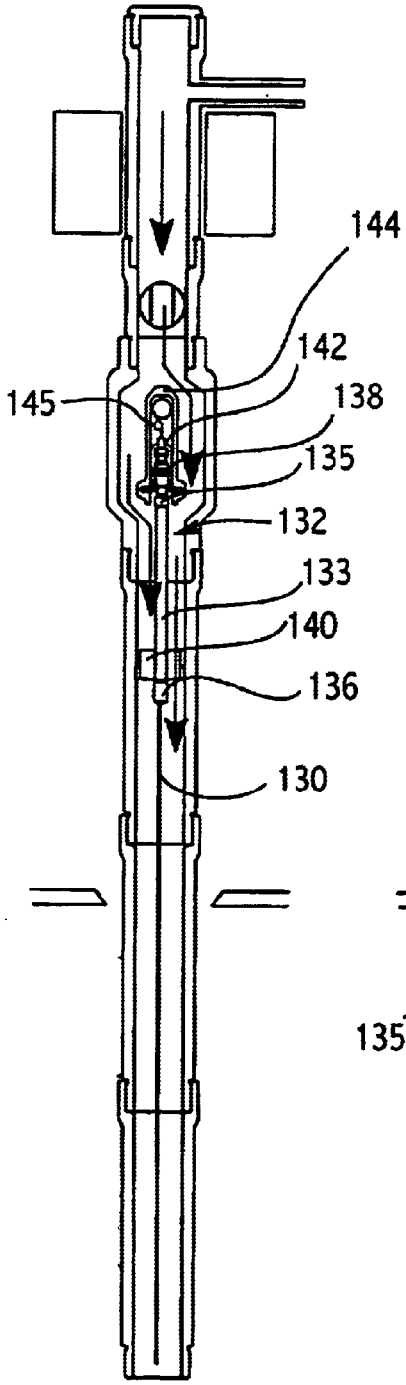
FIGS. 18 to 25 show another embodiment of the invention in operation.

Referring to FIG. 18, in another embodiment of the invention, the wireline 130 terminates in an upper connector 132 comprising a shaft 133 having an upper saddle 135 and a lower saddle 136, and a profiled plug 138. The shaft is disposed in an anchor 140 having a central through-hole which slidably accommodates the shaft. The diameter of the through-hole is smaller than the upper and lower saddles 135, 136, so the shaft 133 of the upper connector is constrained by the anchor.

The plug of the upper connector is releasably held by a fishing socket 142 inside an upper housing 144. There is sufficient clearance around the connector 132 and housing 144 for drilling fluid to circulate and the bore hole is advanced in conventional fashion.

Figure 19:
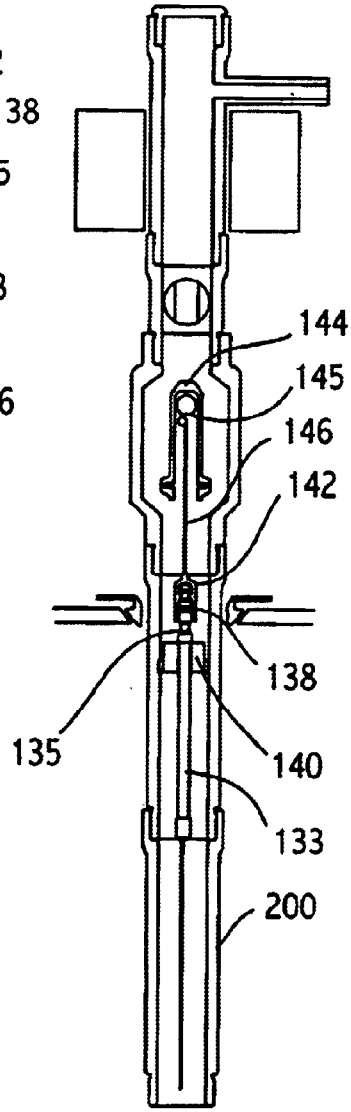

Referring to FIG. 19, when the drill string 200 has advanced sufficiently and it is desired to add a new section of drill pipe 201, the fishing socket 142 is lowered on a winch line 146 from a winch 145 located in the upper housing 144, and this causes the upper connector 142 to slide through the anchor 140 until the upper saddle 135 engages with the side of the anchor's through-hole. In this way, the upper connector 132 is safely stowed during the addition of new drill pipe sections.

Figure 20:
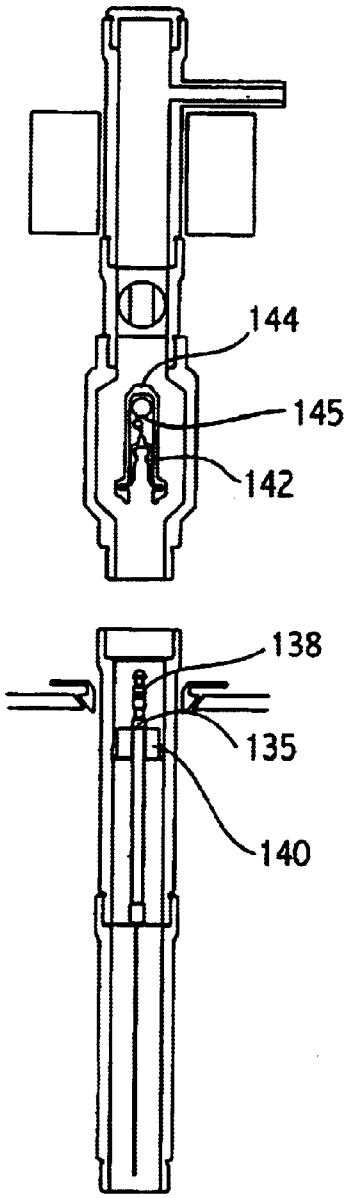
Figure 21:
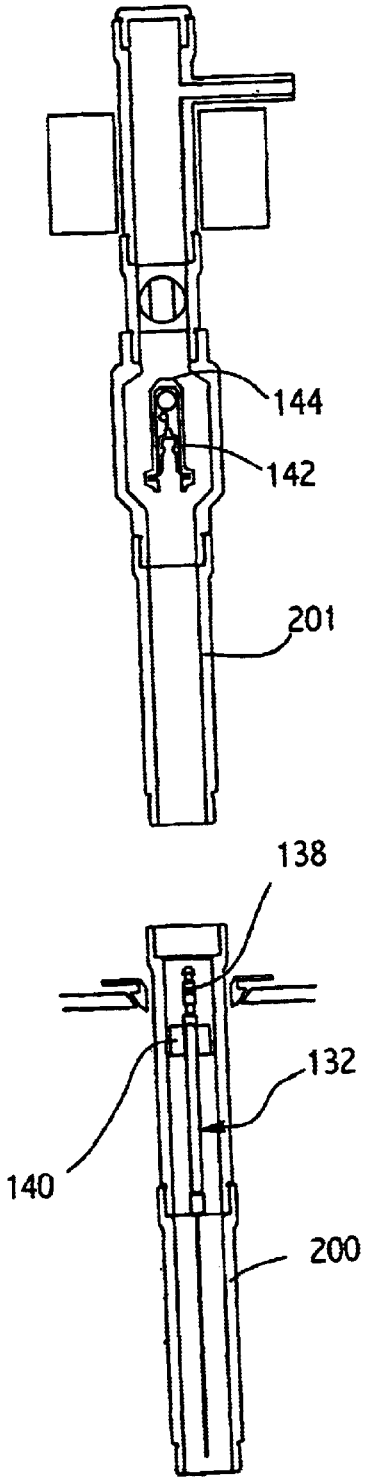
Figure 22:
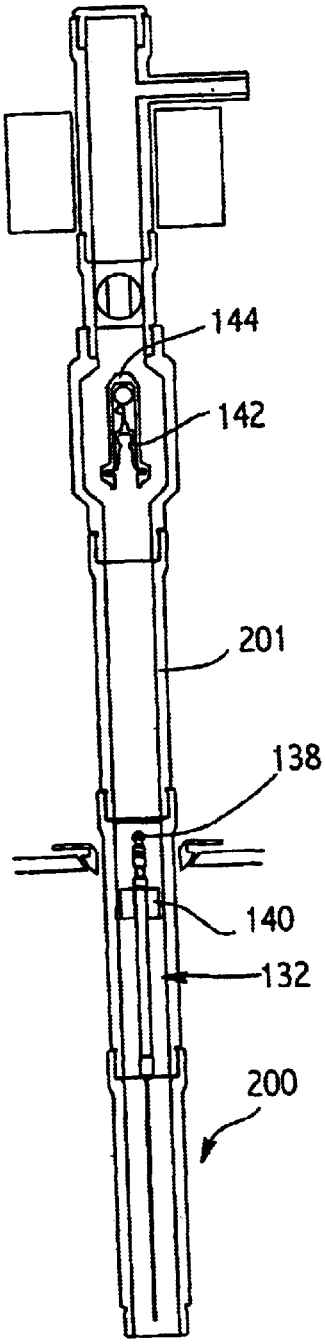

Referring to FIG. 20, the fishing socket 142 releases the plug 138 of the upper connector 132, and is winched back into its housing 144. The drill string 200 may now be broken to allow the addition of a new section of drill pipe 201, shown in FIG. 21. FIG. 22 shows the drill string 200 being remade.

Figure 23:
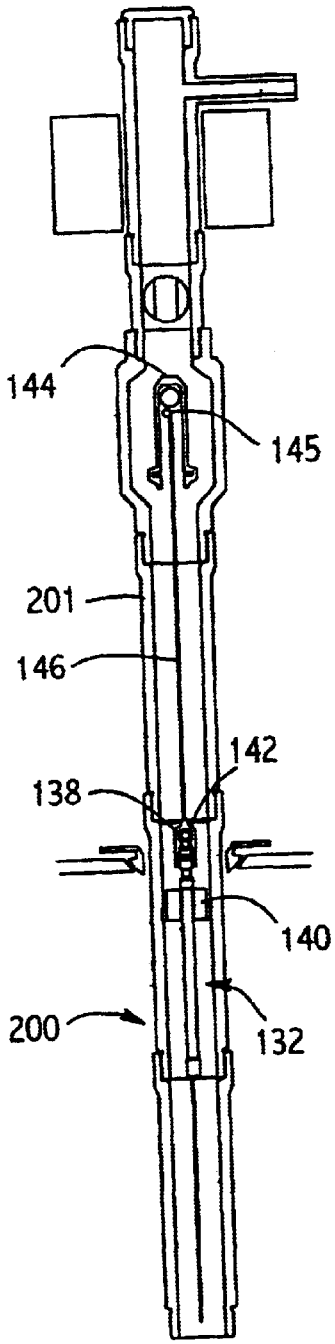
Figure 24:
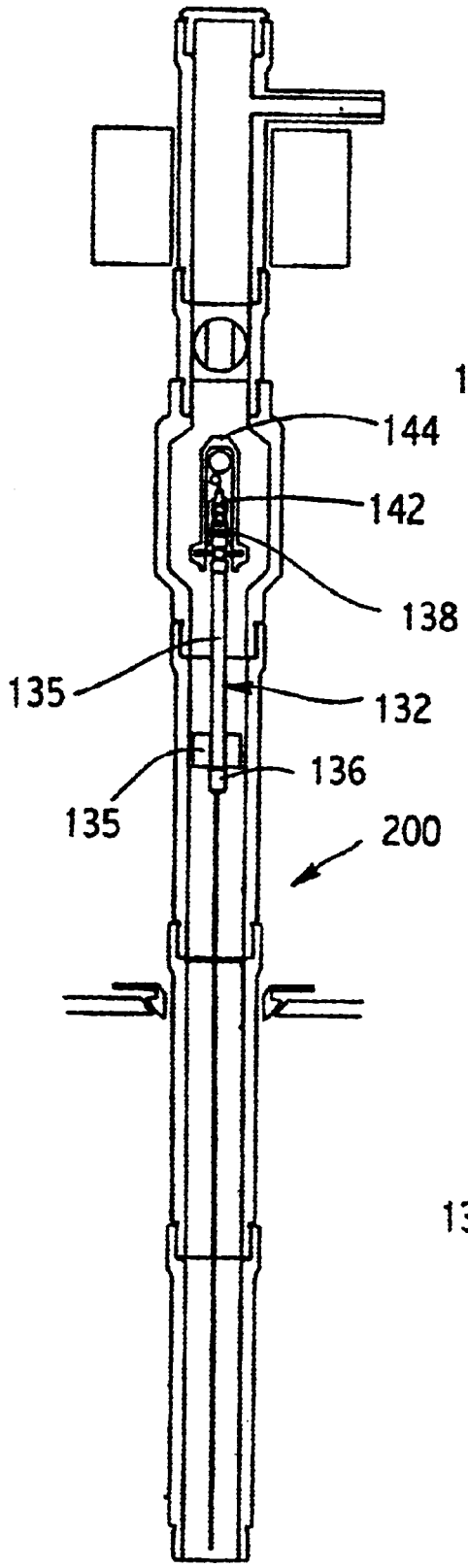

Referring to FIG. 23, the fishing socket 142 is lowered (on the winching line 146 by the winch 145) to the upper connector 132, where it engages with the plug 138. Referring to FIG. 24, the fishing socket 142 is then raised by the winch 145, raising the shaft 133 of the upper connector until the lower saddle 136 engages the anchor.

Figure 25:
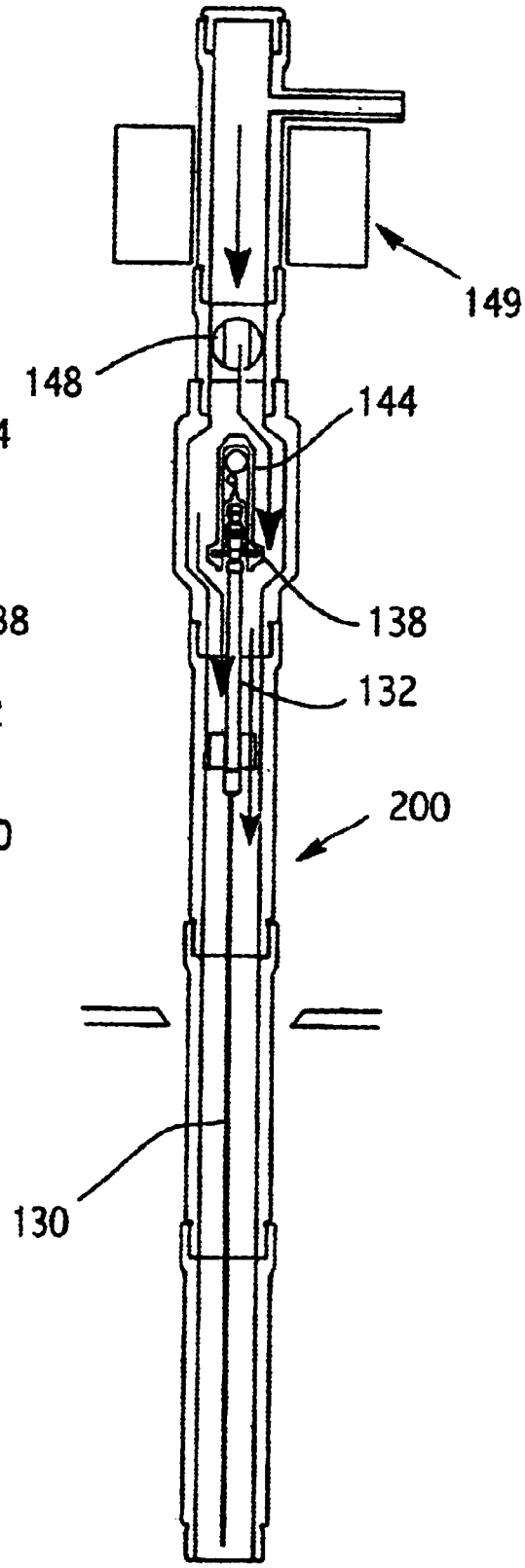

The anchor 140 includes a ratchet means whereby it may be raised when a sufficient force is exerted upon it, but resists any downward movement by gripping the inner diameter of the drill string 200. As the winch continues to raise the fishing socket and upper connector, the anchor is raised by its abutment with the lower saddle. Thus the wireline and its connection arrangements have, in FIG. 25, returned to an equivalent position to that shown in FIG. 18, and the drilling process may recommence (with drilling fluid being allowed through top swivel 149 and safety valve 148) and the procedure may be repeated.

The method of data transfer between the plug 138 and fishing socket 142 is preferably by an inductive link. The upper connector 132 and upper housing 144 may also employ a RF data link (such as the 'bluetooth' system). In this way, data may be continuously transmitted throughout the drilling process, by induction when the fishing socket 142 is engaged or close to the plug 138, and by RF means between the upper connector 132 and upper housing 144 when the fishing socket are separated, and may transmit even when new drill pipe sections are being added.

Figure 26:
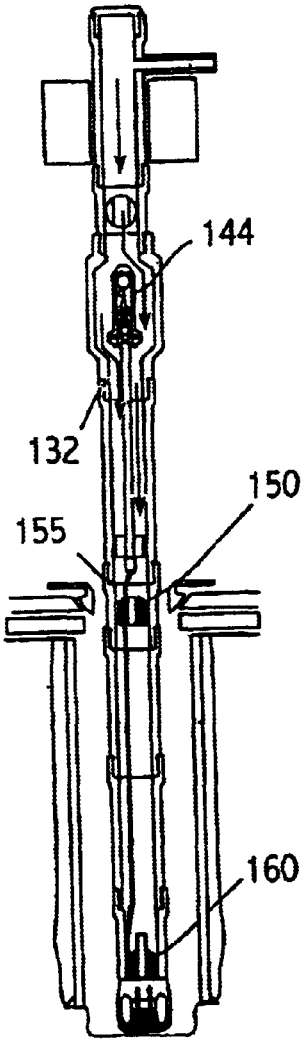
FIGS. 26 to 28 show a further embodiment of the invention in operation.
Figure 27:
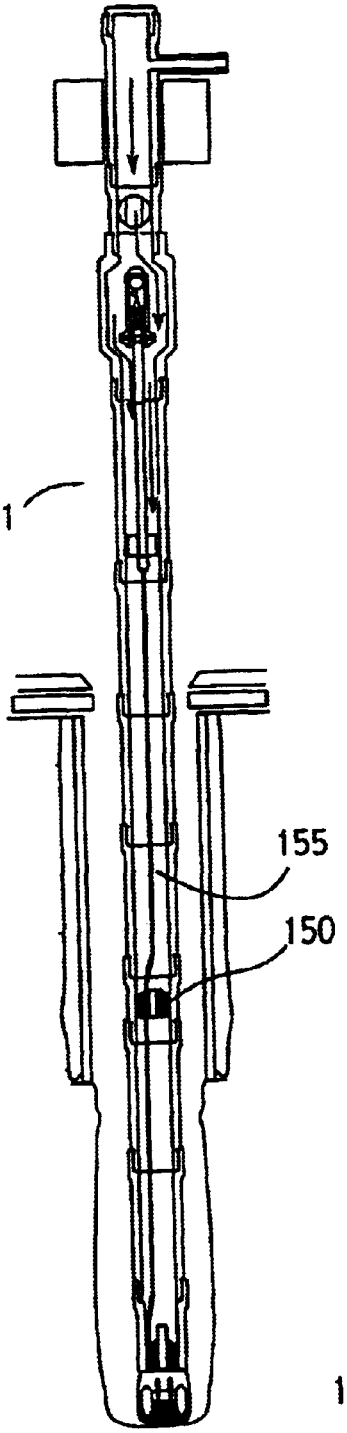

Referring to FIG. 26, the slidable upper connector 132 and anchor 140 are shown above upper 150 and lower 160 cable bobbins. The cable bobbins unwind to release extra cable 155 in the manner previously described to accommodate new lengths of drill pipe 201, as shown in FIG. 27.

Figure 28:
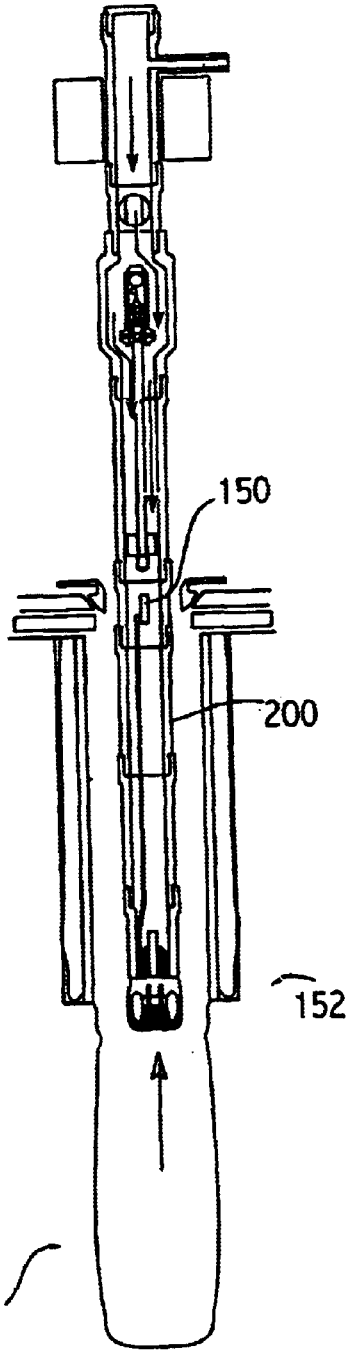

Referring to FIG. 28, it is usual to periodically withdraw and re-lower the drill bit over the lower portion 151 of the borehole 152 that has not had a casing installed, so that debris is removed from around the drill string and the borehole is kept clear. This procedure is known as a 'wiper trip'. When the drill bit 202 and drill string 200 is raised is raised, it is important that the cable released from the bobbins 150, 160 does not become tangled. When the drill string 200 is to be raised, the cable 155 of the upper bobbin 150 is winched up, spooling from the upper bobbin 150. When the cable 155 from the upper bobbin 150 is exhausted, the cable breaks or disconnects from the upper bobbin, and this cable is removed from the drill string 200. The drill string is withdrawn from the portion 151 of the borehole over which the wiper trip is to be performed. The exhausted upper bobbin 150 is then replaced with a new upper bobbin having cable wrapped around it in the manner previously described.

Further upper bobbins may be installed at intervals along the drill string, so that successive wiper trips may be accomplished by winching out the cable of the uppermost bobbin before raising the drillstring and removing the uppermost bobbin when exhausted and replacing with a new bobbin.

Alternative embodiments using the principles disclosed will suggest themselves to those skilled in the art, and it is intended that such alternatives are included within the scope of the invention, the scope of the invention being limited only by the claims.

What is claimed is:

1. A drillpipe line installation system having a drill string composed of drillpipe sections which are added and removed to increase and decrease a length of a drillpipe, wherein a length of cable is disposed within the drillpipe string, the length of this cable being greater than that of the drill string at the time the cable is disposed therein, there being a lower cable storage means having a lower mandrel for stowing the cable in a compact manner in a plurality of windings about the lower mandrel and paying out the cable when the length of the drillpipe is increased, and an upper cable storage means having an upper mandrel which can take up the cable in a compact manner by stowing a number of windings around the upper mandrel when the length of the drillpipe is decreased.

2. A system according to claim 1 wherein the cable includes a wireless transmitter capable of transmitting signals to a signal receiver.

3. A system according to claim 1 wherein the cable is releasably connected to a connector at its top, the cable being disconnected from the connector when a drillpipe section is to be added or removed, threaded through the drillpipe section before being reconnected to the connector, the cable including a wireless transmitter, such that signals carried by the cable can be transmitted by the wireless transmitter to be received by a signal receiving means.

4. A system according to claim 1 wherein the top of the cable is secured relative to the drillpipe after being disconnected, and reconnected by lowering the connector through the drillpipe to the top of the cable.

5. A drillpipe line installation system having a drill string composed of drillpipe sections which are added and removed to increase and decrease a length of a drillpipe, wherein a length of cable is disposed within the drillpipe string, the length of this cable being greater than that of the drillpipe string at the time the cable is disposed therein, an excess cable being stored wound upon a mandrel, the cable wound upon the mandrel being twisted as it is applied such that when the cable is twisted as the mandrel is unwound, the twisting already applied to the cable untwists.

6. A drillpipe line installation system having a drill string composed of drillpipe sections which are added and removed to increase and decrease a length of a drillpipe, wherein a length of cable is disposed within the drillpipe string, the length of this cable being greater than that of the drillpipe string at the time the cable is disposed therein, excess cable being stored wound upon a mandrel, the cable being wound along substantially a length of the mandrel to a single cable thickness and before winding the cable along the mandrel in a second cable thickness, silicone elastomer is to secure the first layer of cable to the second layer of cable.

7. A drillpipe line installation system having a drill string composed of drillpipe sections which are added and removed to increase and decrease a length of a drillpipe, wherein a length of cable is disposed within the drillpipe string, the length of this cable being greater than that of the drillpipe string at the time the cable is disposed therein excess cable being stored wound upon a mandrel, the cable being wound upon itself in an overlapping manner at a given displacement along the mandrel before the cable is wound at another region of the mandrel.

8. A system according to claim 7 wherein the cable is wound upon the mandrel such that exposed turns of the cable have a conical shape.

9. A system according to claim 7 wherein silicone elastomer is used to secure turns of the cables.

* * * * *